US009163787B2

(12) United States Patent
Peak et al.

(10) Patent No.: US 9,163,787 B2
(45) Date of Patent: Oct. 20, 2015

(54) LED BAR

(71) Applicants: In Gi Peak, Seoul (KR); Seung Chul Beak, Samcheok-si (KR)

(72) Inventors: In Gi Peak, Seoul (KR); Seung Chul Beak, Samcheok-si (KR)

( * ) Notice: Subject to any disclaimer, the term of this patent is extended or adjusted under 35 U.S.C. 154(b) by 0 days.

(21) Appl. No.: 14/380,767

(22) PCT Filed: Sep. 16, 2013

(86) PCT No.: PCT/KR2013/008364
§ 371 (c)(1),
(2) Date: Aug. 25, 2014

(87) PCT Pub. No.: WO2014/046439
PCT Pub. Date: Mar. 27, 2014

(65) Prior Publication Data

US 2015/0016102 A1 Jan. 15, 2015

(30) Foreign Application Priority Data

Sep. 21, 2012 (KR) ..... 10-2012-0104846

(51) Int. Cl.

| | |
|---|---|
| ***F21K 99/00*** | (2010.01) |
| ***H05B 33/08*** | (2006.01) |
| *F21Y 101/02* | (2006.01) |
| *F21Y 103/00* | (2006.01) |

(52) U.S. Cl.
CPC ..... *F21K 9/10* (2013.01); *H05B 33/0803* (2013.01); *H05B 33/0821* (2013.01); *F21Y 2101/02* (2013.01); *F21Y 2103/003* (2013.01)

(58) Field of Classification Search
USPC ..... 362/249.02, 219, 221, 225, 217.13, 362/217.17, 647, 652, 655, 656, 657, 658, 362/659, 800
See application file for complete search history.

(56) References Cited

U.S. PATENT DOCUMENTS

| | | | | |
|---|---|---|---|---|
| 2001/0036082 | A1 | 11/2001 | Kanesaka | |
| 2008/0030981 | A1* | 2/2008 | Mrakovich et al. | 362/219 |
| 2008/0298058 | A1* | 12/2008 | Kan et al. | 362/240 |
| 2011/0058365 | A1* | 3/2011 | Osawa | 362/217.01 |
| 2012/0228645 | A1 | 9/2012 | Tu et al. | |
| 2014/0056002 | A1* | 2/2014 | Roberts | 362/249.02 |

FOREIGN PATENT DOCUMENTS

| | | | |
|---|---|---|---|
| JP | 2001-306002 | A | 11/2001 |
| JP | 2010-21123 | A | 1/2010 |
| JP | 2011-253700 | A | 12/2011 |

OTHER PUBLICATIONS

International Searching Authority, International Search Report for PCT/KR2013/008364 dated Jan. 20, 2014.

* cited by examiner

*Primary Examiner* — Laura Tso
(74) *Attorney, Agent, or Firm* — Sughrue Mion, PLLC

(57) ABSTRACT

Disclosed is an LED bar. The LED bar has a plurality of LED units mounted in a cuttable form and each of the LED units has a single LED. The LED bar includes a plurality of LEDs; a bar-shaped base substrate on which the plurality of LEDs are mounted; a plurality of resistors mounted on the base substrate so as to respectively correspond to the plurality of LEDs; and a link formed so that an LED unit formed with one of the plurality of resistors corresponding to the one LED is distinguished from other LED unit that is adjacent to the LED unit.

2 Claims, 6 Drawing Sheets

LED BAR

TECHNICAL FIELD

The present invention relates to a illumination device, and more particularly to an LED bar with a plurality of LEDs emitting light mounted on a bar-shaped base substrate.

BACKGROUND ART

In general, an illumination device uses a high-pressure mercury lamp, a fluorescent lamp or a sodium lamp as a light source for generating light.

In recent, as light emitting diode (hereinafter, briefly referred to as "LED") is developed which has a low power consumption and emits light with a high luminance, the illumination device using the LED as a light source is developed and use of the illumination device is gradually increased.

The illumination device using the LED is generally used for replacing the fluorescent lamp. However, the illumination using the LED is recently used for embellishing wall of a building and also decorating the interior of the building. In particular, users who highly regard their individuality mount the illumination device using the LED on a door of car or a body of motorcycle used by the users.

Namely, the illumination device mounted on the fluorescent lamp, car or motorcycle etc. can be produced by using the LED as described above. In particular, a base substrate on which the LED is mounted is formed as an elongated bar so that the users could freely deform the form of the illumination device. A device of such a form is referred to as an LED bar.

The users can construct the illumination device reflecting their own individuality by cutting the LED bars to a size desired by the users and combining the cut LED bars into a form desired by the users.

Namely, the users who want to use the LED bar for replacing the fluorescent lamp may use the LED bar as a light source for LED fluorescent lamp by cutting the LED bar to a length corresponding to the length of tube constituting the fluorescent lamp and then mounting it on the tube.

Furthermore, the users who want to use the LED bar for various decorations may use the LED bar by cutting the LED bar to the length of device on which the LED bar is to be mounted.

FIG. 1 is a circuit diagram of a conventional LED bar, FIG. 2 is an example view for describing a state of use of the conventional LED bar, FIG. 3 is an external configuration view of an embodiment of the conventional LED bar, and FIG. 4 is an external configuration view of an LED unit cut from the conventional LED bar illustrated in FIG. 3 to be used.

The conventional LED bar (10) has three LEDs (LED1, LED2, LED3) (11) and a single resistor (12) which are connected in series on a base substrate (14), as illustrated in FIGS. 1 and 3, with links (13) as a boundary.

The conventional LED bar (10) may be applied to an illumination device, in the form as illustrated in FIGS. 1 and 3, but also may be applied to the illumination device in the form of LED part cut from the LED bar.

The LED part may be constituted by a single LED unit (10*a*) as illustrated in FIGS. 2 and 4, but also may be constituted by two or more LED units (10*a*).

Namely, the link (13) formed in the LED bar (10) are cut so as to obtain a length desired by a user, and thereafter the LED part cut from the LED bar (10) may be used by being mounted on various illumination devices.

Meanwhile, three LEDs (11) and a single resistor (12) are mounted on the LED unit (10*a*) which is a minimum unit of the LED bar (10 that may be mounted on the illumination device to be used by the user.

Problems of the conventional LED bar as described above are as follows.

Firstly, the conventional LED bar or LED unit has a high power consumption.

In general, the LED has a base value of 3 V to 4.5 V as illustrated in FIG. 2. Therefore, in the case where three LEDs (11) are used while being connected in series as is the case with the conventional LED unit (10*a*), voltage and current applied to the LEDs have to be increased. Therefore, the conventional LED unit (10*a*) consumes much power of 12 V to 40 V.

Namely, since the conventional LED unit (10*a*) has the three LEDs (11) connected with the resistor (12), voltage value of the entire LEDs increases and thus the LED unit has to be configured to be suitable for the voltage of 12 V or more.

Secondly, since the three resistors are formed in the LED unit (10*a*) which is a minimum unit constituting the conventional LED bar, the user cannot construct the illumination device by variously choosing the number of the LEDs.

Namely, since the three LEDs (11) are mounted on the LED unit (10*a*) which is the minimum unit that can be used by being mounted on the illumination device, the conventional LED bar may not be used by a user who wants to construct the illumination device by using only one or two LEDs or a user who wants to construct the illumination device by further using one or two LEDs together with LEDs mounted on the at least one LED unit.

SUMMARY OF THE INVENTION

Technical Problem

The present invention aims at solving the above-mentioned problems, and its object is to provide a LED bar in which a plurality of LED units each having a single LED are mounted in a cuttable manner.

Solution to the Problem

The LED bar according to the present invention for achieving the above object comprises: a plurality of LEDs; a bar-shaped base substrate on which the plurality of LEDs are mounted; a plurality of resistors mounted on the base substrate so as to respectively correspond to the plurality of LEDs; and a link formed so that an LED unit formed by one of the LEDs and at least one of the resistors corresponding to the one LED is distinguished from another LED unit adjacent to the LED unit.

Effects of the Invention

Since the present invention includes a plurality of LED units each having one LED, the amount of power required for driving each of the LED units is low.

Furthermore, according to the present invention, since the plurality of LED units each having a single LED are mounted in a cuttable manner, the user can produce various types of the illumination device, by selecting the same number of LED units as the number of LEDs desired by the user.

BEST MODES FOR CARRYING OUT THE INVENTION

Hereinafter, an embodiment of the present invention will be described in detail with reference to the attached drawings.

Figure 1:
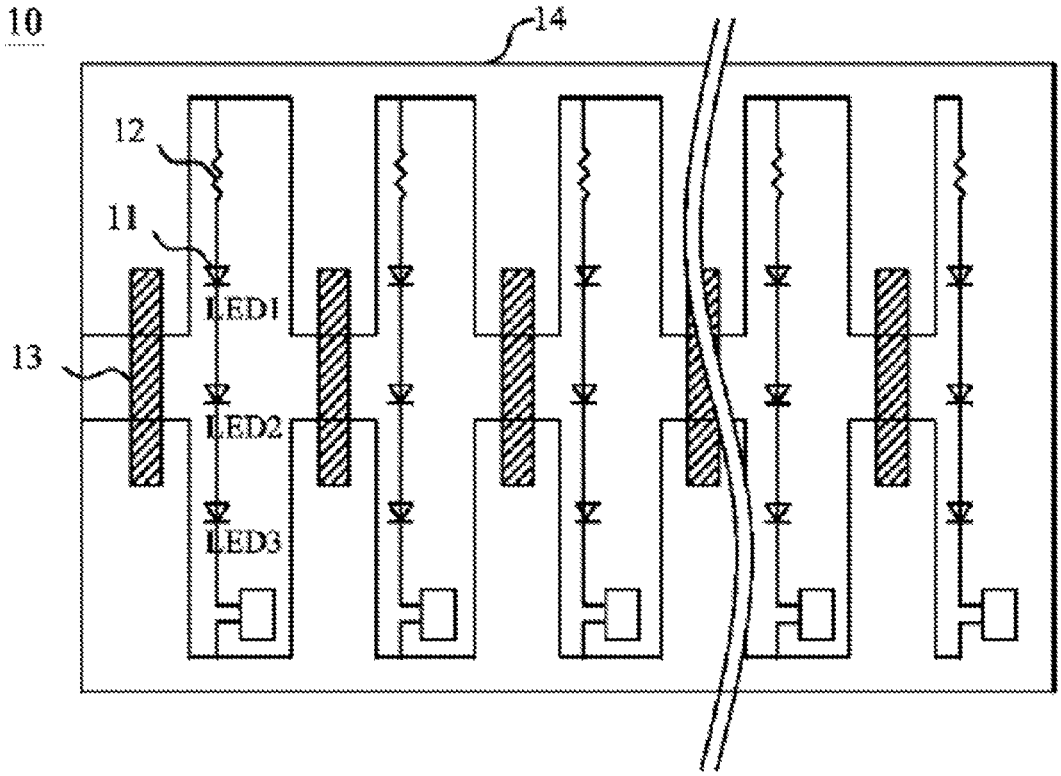
FIG. 1 is a circuit diagram of a conventional LED bar.
Figure 2:
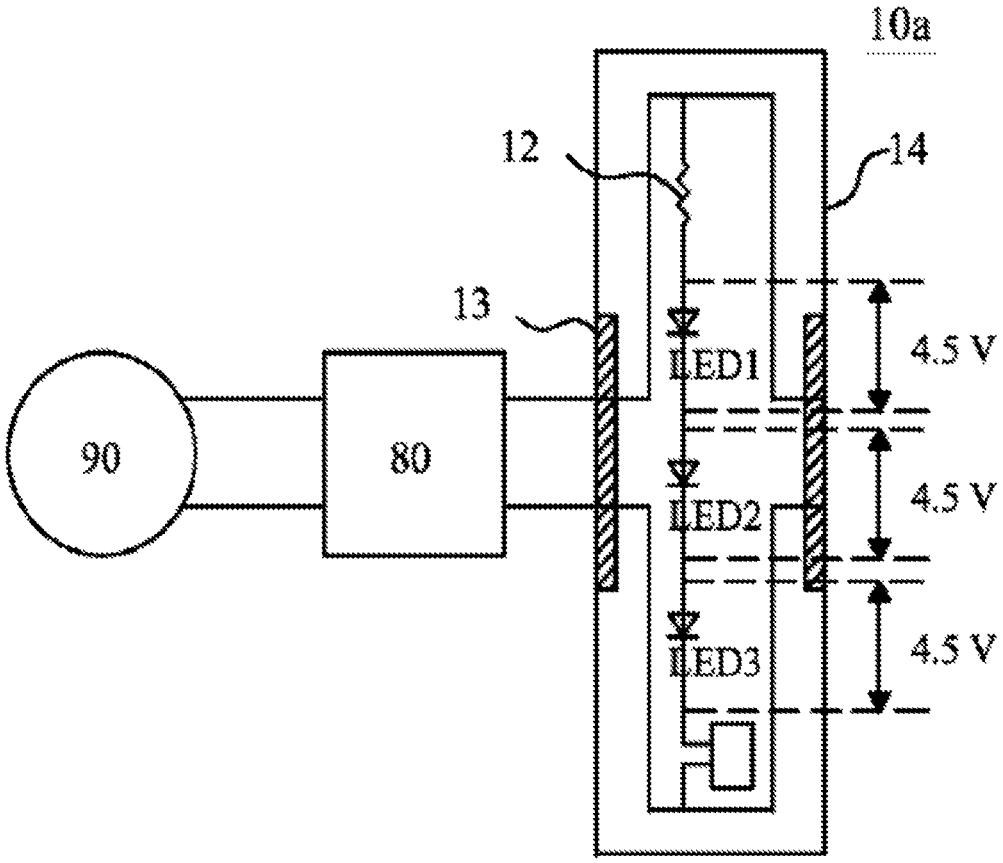
FIG. 2 is an example view for describing a state of use of the conventional LED bar.
Figure 3:
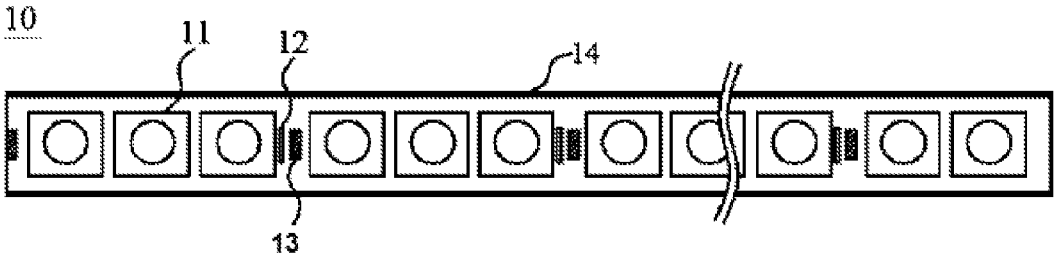
FIG. 3 is an external configuration view of an embodiment of the conventional LED bar.
Figure 4:
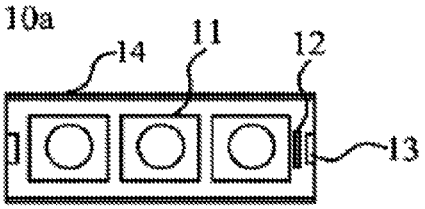
FIG. 4 is an external configuration view of an LED unit cut from the conventional LED bar illustrated in FIG. 3 to be used.
Figure 5:
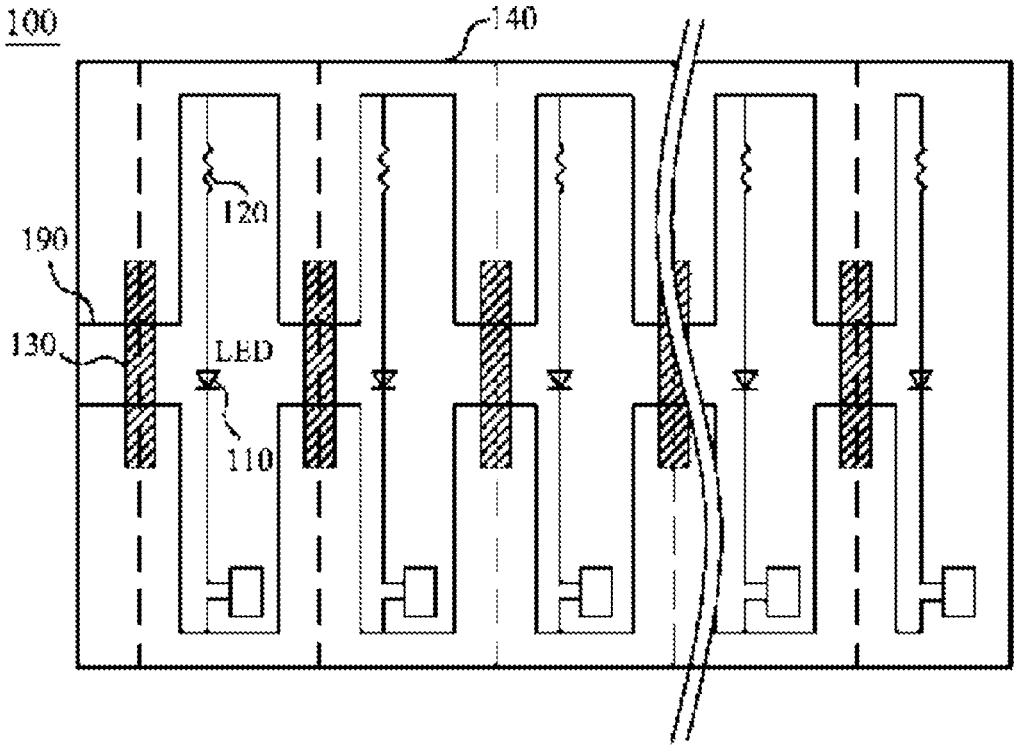
FIG. 5 is a circuit diagram of a LED bar according to the present invention.
Figure 6:
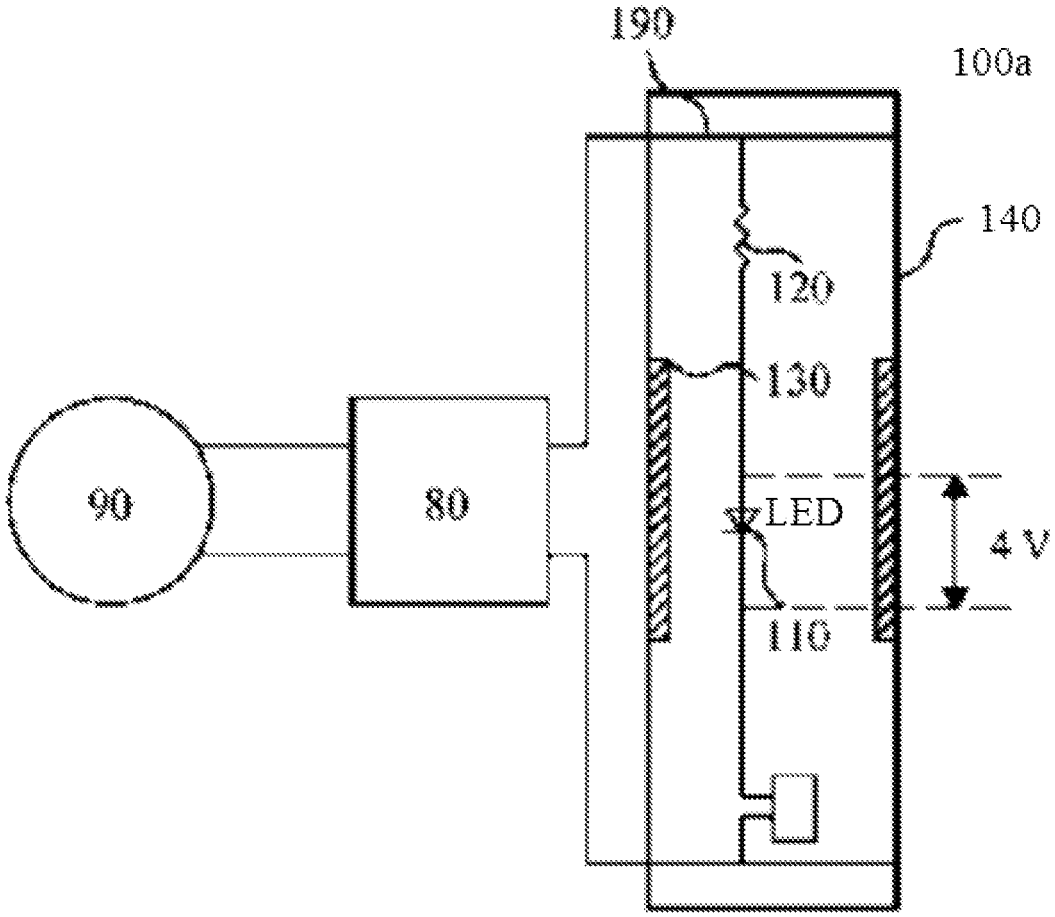
FIG. 6 is an example view for describing a state of use of the LED bar according to the present invention.
Figure 7:
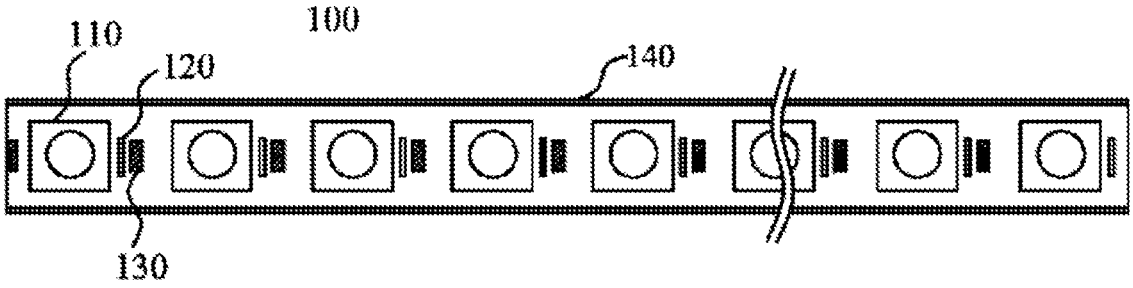
FIG. 7 is an external configuration view of an embodiment of the LED bar according to the present invention.
Figure 8:
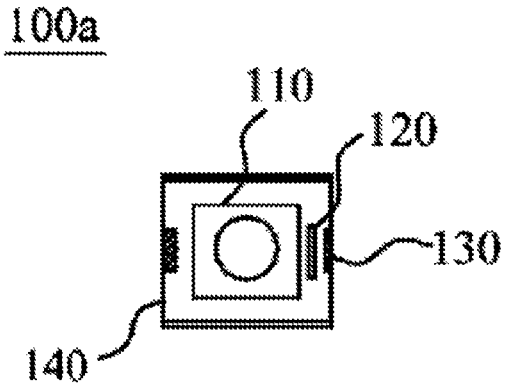
FIG. 8 is an external configuration view of an LED unit cut from the LED bar according to the present invention illustrated in FIG. 7 to be used.

FIG. 5 is a circuit diagram of a LED bar according to the present invention, FIG. 6 is an example view for describing a state of use of the LED bar according to the present invention, FIG. 7 is an external configuration view of an embodiment of the LED bar according to the present invention, and FIG. 8 is an external configuration view of an LED unit cut from the LED bar according to the present invention illustrated in FIG. 7 to be used.

The LED bar according to the present is characterized in that a plurality of LED units each having a single LED are mounted in a cuttable manner. To this end, as illustrated in FIGS. 5 to 8, the LED bar according to the present invention includes a plurality of LEDs (110); a bar-shaped base substrate (140) on which the plurality of LEDs are mounted; a plurality of resistors (120) mounted on the base substrate (140) so as to respectively correspond to the plurality of LEDs (110); and links (130) each formed so that an LED unit (100*a*) formed with one of the plurality of LEDs (110) and at least one of the resistors (120) corresponding to the one LED is distinguished from another LED unit (100*a*) adjacent to the LED unit (100*a*).

Firstly, the LED (Light Emitting Diode) (110) is a type of semiconductor device which allows pass of current in a forward direction, but does not allow the pass of current flow in a reverse direction. The LED forms minority carriers (electrons, electron holes) by using a P-N junction structure of semiconductor and emits light by recoupling them.

It is general that the LED (110) is used in a module unit rather than in a chip unit. The LED of the chip unit is commonly referred to as "LED chip" and the LED of the package unit is commonly referred to as "LED module". Herein, the LED module includes the LED chip.

Namely, the LED module has the LED chip mounted thereon and refers to a LED device produced so as to be able to be attached to a printed circuit board (PCB). Hereinafter, the LED refers to the LED chip or LED module.

Next, the resistor (120) serve to protect the LED (110).

The resistor (120) and the LED (110) are connected in series as illustrated in FIGS. 5 and 6.

Therefore, the resistor (120) may be set to various resistance value, considering voltage supplied to the LED and driving voltage of the LED. Furthermore, only one resistor (120) may be connected in series with the LED (110), but two or more resistors may also be connected in series or parallel with the LED, considering the resistance value.

Next, the base substrate (140) is a bar-shaped substrate on which the plurality of LEDs (110) and the plurality of resistors (120).

On a lower surface of the base substrate (140), a heat discharge plate (not illustrated) may be mounted.

Namely, the LED (110) has to exhibit an excellent heat emission property since it emits much heat when outputting light. To this end, in the present invention, the LEDs (110) are mounted on a upper surface of the base substrate (110) and the heat discharge plate may be mounted on the lower surface of the base substrate (140). The heat discharge plate may outwardly discharge heat generated from the LEDs by means of natural convection.

In this case, the heat discharge plate may be formed between the base substrate (140) and a lower substrate (not illustrated) which is mounted on the base substrate with a fixed distance therefrom on a lower side of the base substrate. Therefore, the lower substrate is substantially attached to the illumination device when the LED bar (100) according to the present invention or the LED unit (100*a*) or the LED part is mounted on the illumination device.

The base substrate (140) may be formed of a mixture of epoxy and ceramics, or may be formed of bendable synthetic resin.

Namely, the base substrate (140) is a place where the plurality of LEDs (110) and the plurality of resistors (120) are mounted, and may be constituted by only one substrate or by a plurality of substrates (base substrate and lower substrate), and may be configured such that the heat discharge plate is arranged between the base substrate (140) and the lower substrate spaced apart from each other. Furthermore, the base substrate (140) may be formed of non-bendable material such as metal, but also may be constituted by a bendable substrate. Namely, the base substrate (140) may be constituted by substrate of various materials such as epoxy substrate, phenol substrate, flexible substrate, aluminum substrate etc.

Finally, the links (130) serve to distinguish the LED unit (100*a*), which is constituted by one LED (110) and at least one resistor (120) connected with the LED, from another adjacent LED unit (100*a*).

In particular, the links (130) are formed on the base substrate such that the LED unit (100*a*) can be separated from the another LED unit when an external force is applied by a user. Namely, the links (130) are configured such that it can be cut by the external force applied by the user, even without using cutting means such as a knife or scissors.

Therefore, the user can separate the LED part including the LED units (100*a*) of only a number desired by the user, from the LED bar (100) where the at least two LED units are distinguished from each other by the links (130).

Namely, the user who wants to produce the illumination device by using only one LED unit (100*a*) can separate the only one LED unit (100*a*) from the LED bar (100).

Furthermore, the user who wants to produce the illumination device by using the LED part constituted by the two LED units (100*a*) can separate only two LED units (100*a*) from the LED bar (100) by cutting the link (130) formed between an end of each of the two LED units (100*a*) and another LED unit (100*a*) adjacent to the end.

The LED and the resistor formed in each LED unit (100*a*) are connected in parallel with the LED and the resistor formed in another LED unit, as illustrated in FIG. 5.

Therefore, even if the LED units (100*a*) are cut form the LED bar (100) with the links being a boundary, the LEDs in the LED units can emit light by using power supplied form the power supply device (90). Reference numeral "80" in FIG. 6 refers to an analog-digital converter (DAC). Namely, in a case where the power supply device (90) supplies alternating current, the analog-digital converter (80) can convert the alternating current to direct current to supply the direct current to the LED (110) mounted on the LED unit (100*a*).

For further description, since the LED units (100*a*) are connected in parallel, the LED unit (100*a*) formed at any position in the LED bar (100) can be normally driven even when the LED unit (100*a*) is separated from the LED bar (100). Furthermore, the LED part including at least one LED unit (100*a*) can also allow the LEDs each mounted on the at least one LED unit (100*a*) to emit light by using the power supplied from the power supply device (90).

Meanwhile, FIG. 5 shows that electric wires (190) connecting the LED units (100*a*) in parallel are connected through the links (130), but the electrical wires (190) may be formed on the portion of the base substrate (140) where the links (130) are not formed, as illustrated in FIG. 6. Namely, two LED units (100*a*) connected through one link (130) can be easily separated by means of the links (130). In this case, as illustrated in FIG. 5, the electrical wires (190) exposed through the links (130) as illustrated in FIG. 5, or the electrical wire (190) exposed through a portion other than the links (130) as illustrated in FIG. 6 can be connected with the power supply device (90) by the analog-digital converter (80).

Features of the present invention including the constituents as described above may be mainly summed up into two features as follows.

Firstly, the LED bar (100) according to the present invention or the LED unit (100*a*) separated from the LED bar (100) or the LED part constituted by at least one LED unit (100*a*) is constituted by a small number of the LEDs (110), thereby having a low power consumption.

The LED using the power of 12 V or less as is the case with the present invention uses a low voltage as a power source and thus the LED can be set to favor a piece-wise characteristic of each LED, whereby the characteristic of LED can be improved.

Namely, driving voltage of the LED is generally from 3.0 V to 4.5 V, and the present invention has a structure where one resistor (120) and one LED (110) are connected in series with each other as illustrated in FIGS. 5 and 6, and thus the voltage and current applied to the LED (110) can be reduced. Therefore, the present invention can improve the piece-wise characteristic and durability of the LED by reducing the generation of heat of the LED.

In the present invention, the driving voltage value of the entire LEDs (VF[V]) can be optimized since the resistor (120) is connected with one LED (110). Therefore, the present invention has a characteristic that it is configured to be used at the voltage of 12 V or less, thereby minimizing watt capacity of the resistor and the brightness can be uniformly adjusted on a LED-by-LED basis. Furthermore, due to the characteristic as described above, the present invention enables the LED (110) to emit light at a low voltage.

Namely, since the diving voltage (VF) value of the LED is low, each LED can uniformly emit light even when D/C power of 12 V or less is used.

Secondly, the user can choose various numbers of the LEDs (110) to construct the illumination device, since one LED (110) is connected with the resistor (120) in the LED unit (100*a*) which is the minimum unit constituting the LED bar (100).

Namely, since one LED (110) is mounted on the LED unit (100*a*) which is the minimum unit that can be used by being mounted on the illumination device, a user who wants to construct the illumination device by using only one or two LEDs or a user who wants to construct the illumination device by further using one or two LEDs together with LEDs (110) mounted on the at least one LED unit (100*a*) can separate and use the LED unit (100*a*) from the LED bar (100) in accordance with the number of the LEDs.

Therefore, the user can construct the illumination device, using the LEDs of just a number desired by the user, whereby there are no LEDs which are unnecessarily wasted in construction.

The features of the present invention as described above will be described with comparison with the conventional LED.

Since the conventional LED bar currently commercially available uses a high voltage from DC 12 V to 40 V, there is no significant difference in electrical efficiency between the conventional LED bar and existing fluorescent lamp. Furthermore, the conventional LED bar has a problem that the durability of LED is low and a design for discharge of heat is difficult since the bar uses a high voltage.

Furthermore, the conventional LED bar includes one resistor per three LEDs and is designed to be used by cutting three LEDs as a unit through the link. Therefore, the user cannot accurately choose the LEDs of a number desired by the user, and accordingly, there are LEDs which are unnecessarily wasted in construction.

On the contrary, the present invention uses the power of DC 12 V or less, and thus maximizes efficiency of lamp apparatus. Furthermore, the present invention allows a separate control for each LED and also low-voltage drive, and can solve problems related to generation of heat and safety by using a voltage band in which electrical properties and the LED are stable.

Furthermore, the present invention can maximize the efficiency of use of the LED bar since a set is used per one LED. Namely, the present invention uses the power of 12 V or less and also cuts and uses the LED unit including one LED from the LED bar, thereby enabling a design which allows installation and construction to be efficient.

In the case where the present invention uses the LED (110) of 4 V as illustrated in FIG. 6, inputted voltage input to the LED bar (100) according to the present invention, LED unit (100*a*) or LED part is 5 V, and output thereof is 100 W. By increasing the brightness, power may be saved by up to 50%.

Furthermore, stabilizer may be mounted on each LED unit (100*a*) constituting the LED bar (100) according to the present invention.

It is obvious to those skilled in the art that the present invention may be implemented in another specific forms without change of technical concepts or essential features of the present invention. Therefore, it should be understood that the embodiments described above are illustrative in all respects and are not limitative. The scope of the present invention is defined by the following claims rather than the above detailed description, and all of altered or modified forms derived from the meaning and scope of claims and equivalent thereof should be construed to fall within the present invention.

The invention claimed is:

1. An LED bar comprising:

a plurality of LEDs;

a bar-shaped base substrate on which the plurality of LEDs are mounted;

a plurality of resistors mounted on the base substrate so as to respectively correspond to the plurality of LEDs; and links each formed so that an LED unit in which one of the LEDs and one of the resistors corresponding to the one LED are connected in series is distinguished from another LED unit adjacent to the LED unit, wherein at least two LED units are formed on the base substrate, the links are formed on the base substrate such that the LED unit can be separated from the another LED unit when an external force is applied by a user, the LED and the resistor formed in the LED unit are connected in parallel with the LED and the resistor formed in the another LED unit, electric wires connected with the LED unit and the resistor are formed on the portion of the base substrate where the links are not formed, driving voltage of the LED mounted on the one LED unit is from 3.0 V to 4.5 V, the LEDs are connected in parallel, and power of 12 V or less is applied from a power supply device via the base substrate to each of the LED units.

2. The LED bar according to claim 1, wherein LED part comprising the at least one LED unit allow the LEDs respectively mounted on the at least one LED unit to emit light, by using the power supplied from the power supply device.

* * * * *